US006251250B1

(12) United States Patent
Keigler

(10) Patent No.: US 6,251,250 B1
(45) Date of Patent: Jun. 26, 2001

(54) METHOD OF AND APPARATUS FOR CONTROLLING FLUID FLOW AND ELECTRIC FIELDS INVOLVED IN THE ELECTROPLATING OF SUBSTANTIALLY FLAT WORKPIECES AND THE LIKE AND MORE GENERALLY CONTROLLING FLUID FLOW IN THE PROCESSING OF OTHER WORK PIECE SURFACES AS WELL

(76) Inventor: Arthur Keigler, 20 Pine Plain Rd., Wellesley, MA (US) 02481

( * ) Notice: Subject to any disclaimer, the term of this patent is extended or adjusted under 35 U.S.C. 154(b) by 0 days.

(21) Appl. No.: 09/390,110

(22) Filed: Sep. 3, 1999

(51) Int. Cl.[7] ..... C25D 5/08; C25D 5/22; C25D 21/10; C25D 7/12

(52) U.S. Cl. ..... 205/89; 205/96; 205/133; 205/148; 205/157; 204/224 R; 204/273; 204/230.2; 204/275.1

(58) Field of Search ..... 205/96, 148, 261, 205/101, 157, 89, 133; 204/242, 275.1, 269, 273, 222, 224 R, 230.2

(56) References Cited

U.S. PATENT DOCUMENTS

| | | | | |
|---|---|---|---|---|
| 5,472,592 | * | 12/1995 | Lowery | 205/137 |
| 5,478,149 | * | 12/1995 | Quigg | 366/273 |
| 5,516,412 | * | 5/1996 | Andricacos et al. | 204/224 R |
| 5,931,029 | * | 8/1999 | Kim | 68/134 |
| 6,001,235 | * | 12/1999 | Arken et al. | 205/137 |
| 6,027,631 | * | 2/2000 | Broadbent | 205/137 |

* cited by examiner

*Primary Examiner*—Kathryn Gorgos
*Assistant Examiner*—Michael J Feely
(74) *Attorney, Agent, or Firm*—Rines and Rines

(57) ABSTRACT

A novel method and apparatus of wet processing workpieces, such as electroplating semiconductor wafers and the like, that incorporates reciprocating processing fluid agitation to control fluid flow at the workpiece, and where electric fields are involved as in such electroplating, controlling the electric field distribution.

51 Claims, 7 Drawing Sheets wafer #28, large shields, 250A seed

METHOD OF AND APPARATUS FOR CONTROLLING FLUID FLOW AND ELECTRIC FIELDS INVOLVED IN THE ELECTROPLATING OF SUBSTANTIALLY FLAT WORKPIECES AND THE LIKE AND MORE GENERALLY CONTROLLING FLUID FLOW IN THE PROCESSING OF OTHER WORK PIECE SURFACES AS WELL

FIELD OF THE INVENTION

The present invention relates to the control of fluid flow in the wet processing of the surfaces of workpieces in such applications as electroplating and the like, where electric fields may also be involved, being more particularly, though not exclusively, directed to the processing of substantially thin or planar workpieces such as silicon semiconductor wafers and the like, by the automatic and controlled processing application and removal of fluid from such surfaces, as well as more generally the control of wet processing of other types of workpiece surfaces including wet processing without electric fields, as later discussed

BACKGROUND OF THE INVENTION

While, as above indicated, the invention has general application and usefulness in various types of wet processing of a myriad of workpiece surfaces, the principal thrust of the preferred embodiment and particular advantageous use of the invention resides in the field of electroplating, and more specifically for such applications as the electroplating of thin planar workpiece surfaces such as silicon semiconductor wafers and the like though the invention will therefore illustratively be described hereinafter as applied to such usage, it is to be understood that it has decided utility, also, for controlling flow or movement of processing fluids at workpiece surfaces more generally, including as further examples, in electroless plating processes, chemical etching, photo resist coating and stripping, spin-on glass and other dielectric coatings, wafer cleaning processes, and the like. While electro-etching processes and the like, similarly to electroplating, also require electric field control, other processes such as cleaning and the like do not involve the use of electric fields.

Turning, therefore, to electroplating applications as illustrative, such electroplating has been widely used for many years as a manufacturing technique for the application of metal films to many different kinds of structures and surfaces. It has been particularly advantageous in semiconductor or solid-state wafer workpiece manufacturing for the application of copper, gold, lead-tin, indium-tin, nickel-iron, and other types of metals or alloys of metals to the wafer workpiece surfaces. An important requirement of the machines used for such a process is that they be capable of depositing metal films with uniform and repeatable characteristics, such as metal thickness, alloy composition, metal purity, and metal profile relative to the underlying workpiece profile For high-volume manufacturing, it is economical to process workpieces using an automated robotic tool, in which a central robot distributes the workpieces to and from separate processing chambers—commonly referred to as a cluster tool that enables the processing of many workpieces per hour and many workpieces per unit of floor-space occupied by the tool. In the exemplary embodiment of such a cluster tool for electroplating in the field of integrated semiconductor circuit manufacturing, the electroplating is used to apply copper films to silicon workpieces for interconnection wiring, to apply lead-tin solder bumps to the workpieces, and also to apply gold to the workpieces. The process chamber designed for such an electroplating cluster tool addresses the various arts of electroplating, fluid mixing, and fluid control. Various features of such a processing chamber can make its integration into an automated wafer handling cluster tool more efficient and useful for manufacturing. It is to these applications as they relate more specifically to a manufacturing cluster tool wet processing chamber, that the present invention is primarily addressed.

At least three factors, however, make it difficult to design equipment that is capable of producing substantially uniform metal films. First, the plating current spreads out when passing from the anode to the cathode, usually resulting in thicker plated deposits near the outer edge of the workpiece. Secondly, the fluid distribution in the electroplating chamber, particularly at the anode and cathode surfaces, may not be uniform. Non-uniform fluid distribution at the cathode, for example, can cause variation of the diffusion boundary layer thickness across the workpiece surface, which, in turn, can lead to non-uniform plated metal thickness and non-uniform alloy composition. Thirdly, the ohmic potential drop from the point on the workpiece at which the electroplating current enters the workpiece may be non-uniform across the workpiece surface, leading to variation in plating current at the workpiece surface and consequently leading to non-uniform metal film deposition.

The prior art reveals several approaches that have been developed to try to minimize one or more of these sources of non-uniformity in the deposited films, particularly for thin and flat workpieces such as wafers and the like. A common arrangement, for example, is described as a fountain plating chamber, or a "fountain plater" as in Schuster et al U.S. Pat. No. 5,000, 827, embodying a fountain or cup plater wherein the water surface to be plated is positioned face down. To control non-uniformity due to edge effects, a method is disclosed wherein the reduction of deposition rate due to fluid effects and the increase in deposition rate due to electric field effects at the workpiece perimeter are balanced against one another to cause substantially uniform plating across the whole workpiece surface. Unfortunately, however, this arrangement is difficult to incorporate in a machine that automatically loads and unloads workpieces in and from the plating chamber. A patent to Stierman et al, U.S. Pat. No. 5,024, 746, as another example, describes a means of operating with a workpiece facing upward toward the cathode such that bubbles will float upwards from the growing plated metal surface to reduce the effect of entrapped air bubbles blocking metal deposition onto the workpiece. This approach, however, requires workpiece attachment means which are difficult to automate for manufacturing. Unlike either of such prior art approaches, the present invention is designed to provide fluid mixing near the growing metal surface which effectively washes entrapped air bubbles from the workpiece surface and carries them out of the plating chamber, as later more fully explained.

As known to those familiar in the art, the technique of fountain plating requires the providing of a distance between the fluid inlet and cathode workpiece which is similar to or greater than the radius or cross-dimension of the cathode workpiece being plated in order to cause acceptably uniform fluid flow at the workpiece surface. Fluid enters at the bottom of the chamber and flows through the anode toward the cathode workpiece surface. The position of fluid passages in the anode, the position of the anode between the fluid inlet and cathode, and the overall size of the fluid chamber are variables that can be changed to influence the uniformity of the electroplated film. The patent to Lytle et al, U.S Pa. No. 5,391, 285, for example, describes a fountain plating cell wherein the anode, the cathode workpiece and the fluid inlet separation distances can be adjusted to cause uniform flow at the cathode workpiece surface. In an article by T. Lee, W. Lytle, B. Hileman, entitled *Application of a CFD Tool in Designing a Fountain Plating Cell for Uniform Bump Plating of Semiconductor Wafers*, IEEE Trans. On Components, Packaging, and Manufacturing Technology, Part B. Vol. 19, No. 1, February 1996, p. 131, there is a description of how the fluid chamber size, along with the position of the anode in the chamber, can be optimized for producing the best uniformity of plated deposits on a cathodic wafer surface. An inlet to wafer spacing of 70% of the wafer diameter is shown to be. For a 300 mm wafer, as an illustration, this would be a 210 mm fluid chamber height. While in a cluster tool, the compactness of the plating chamber is important for maximizing the economy of the manufacturing process, such prior art fountain plating chambers are decidedly not economical in this regard. As later more fully explained, the present invention, on the other hand, provides a compact electroplating chamber with uniform fluid distribution that has a vertical dimension that is a small fraction of the wafer diameter and is therefore eminently suitable for economical integration into a manufacturing cluster tool.

Another technique for fluid control near the cathode surface known in the prior art, is that of flowing the plating solution through the anode in specific arrangement to cause the fluid to impinge perpendicularly upon said surface. The patent to Croll et al., U.S. Pat. No. 3,317,410 and the patent to Bond et al, U.S. Pat. No. 3,809, 642, for example, describe the use of a flow-through anode to direct the flow of electrolyte orthogonal to the cathode surface, causing fluid mixing at the surface and thereby reducing ionic species concentration variations at the cathode surface. A related method is disclosed in U.S. Pat. No. 5,514,258 to Brinket, wherein a fluid flow collimator plate is disposed between the anode and the cathode and the aperture shape in the plate is designed to ensure laminar flow at the workpiece surface. Because they require an amount of fluid flow proportional to the cathode area, however, these techniques are not practical for substantially large workpieces such as, for example, 200 millimeter and 300 millimeter silicon wafers for which the present invention, with its adequate fluid agitation near the surface of such large workpieces, is particularly suited.

A modification of this directed - flow technique is disclosed by Grandia et al, in U.S. Pat. No. 4,304,641, wherein a rotating flow through a jet plate anode with nozzles of prescribed position and size is used, uniformly to distribute the plating solution on the workpiece-cathode where the metal film is deposited. An apparatus and method for rotating either the workpiece cathode assembly or the anode jet plate assembly is therein described. Tzanavaras and Cohen, in U.S. Pat. No. 5,421, 987, also use such a rotating anode/jet assembly to cause the plating solution to impinge upon the workpiece in a substantially turbulent manner, but uniformly across the workpiece surface. A high-volume flow of plating solution is thus forced through the rotating jet assembly. In these types of systems, solution is pumped into the plating chamber through a rotating seal, requiring a motor, a bearing and a feed-through assembly outside of the plating chamber. In a high-volume manufacturing cluster tool assembly, however, these components would take up valuable space, reducing the economy of the manufacturing tool. In accordance with the present invention, on the other hand, substantial fluid agitation is achieved without a requirement of high-volume fluid flow and without the use of a rotating fluid feed-through or a motor and bearing external to the plating chamber Still a further prior art approach to trying to solve these problems, is that of using a paddle arm to agitate plating solution near the cathode surface. The patent to Powers and Romankiw, U.S. Pat. No. 3,652,442 is illustrative of the use of a paddle arm moving linearly across the cathode surface during plating. This method has been refined and has, in fact, become the standard manufacturing method in the field of plating magnetic films in the thin film magnetic head industry. A drawback of this method for application to high-volume silicon wafer manufacturing, however, is that it requires a linear drive system that extends a distance larger than the workpiece diameter from the process chamber in a plane substantially parallel to the workpiece surface. Reynolds, in U.S. Pat. No. 5,683, 564, discloses still another method of using rotational paddle-like motion to create fluid agitation in an electroplating cell. A fluid-powered turbine is unitarily formed with a wiper blade that moves near the workpiece surface to prevent hydrogen bubble accumulation on the workpiece surface. In this approach, the wafer is immersed vertically in a cathode chamber in the plating bath—a disposition unsuited, however, for the kind of rapid loading and unloading of wafers required in a high-volume manufacturing system. In contrast, as later explained, the present invention discloses an apparatus for generating rotational motion to agitate the fluid in the process chamber wherein the apparatus does not extend substantially beyond the walls of the plating chamber and wherein the chamber itself is configured such that wafers may be rapidly loaded and unloaded in a fashion particularly suited to incorporation into a manufacturing cluster tool.

Turning, now, to prior art chamber designs, it is known that fluid motion within a circularly symmetric chamber can be very non-isotropic. If the fluid is stirred in one direction, a Coriolis motion is established. A particularly deleterious feature of this type of motion for electroplating chambers or other precision process chambers is the tendency for lighter particles, such as air bubbles, to be drawn toward the axis of rotation, thereby displacing reactants from the surface and causing non-uniform reaction rates on the workpiece surface. This non-uniformity must particularly be avoided in processes such as the before-mentioned wet chemical etching of the workpiece surface or wet chemical stripping of photo-resist from the workpiece surface. Such a Coriolis pattern in the fluid can, however, be avoided by periodically forcing the fluid to rotate for a short time in one direction and then causing the fluid to rotate in the reverse direction for a short time. This kind of reversing rotation operation is embodied in the present invention to provide for precisely and reliably controlling cyclic rotational motion in the fluid inside the process chamber. While it has earlier been known that magnetic couplings can be used to impart motion to a fluid inside a chamber through the use of an energy source outside the chamber, such as magnetic stir bars and magnetically coupled pumps, this invention provides for novel precise controlling of the reciprocating movement of a mechanical stirring component within the chamber from an energy source outside the chamber, and without using a shaft that must pass through the chamber wall which can involve leakage and other problems.

An important feature of a wet process chamber that is designed for electroplating or electro-etching chambers or the like, moreover, is the capability of the chamber to produce an electric field pattern on the workpiece that is either substantially uniform or can be readily tailored to a desired shape. A number of methods and designs have been previously developed to cause the electric field on the workpiece surface to be substantially uniform. These fall into two main categories. A first proposal has been to dispose a conducting element, commonly referred to as a current "thief", in the same plane as the workpiece so that it substantially surrounds the workpiece. A voltage is applied to the element that may be equal to the cathode voltage or controlled to a different voltage as required to influence deposition on the cathode surface. An example is provided in U.S. Pat. No. 5,620, 581 to Ang, using a wafer holder with an integral "thief" ring. A further prior proposal is to position substantially insulating plates between the anode and the cathode to reduce the electric field flow to specified locations on the cathode surface. In Grandia et al, U.S. Pat. No. 4,304, 641, an annular current deflector is used, connected to the anode jet plate to improve the radial uniformity of current that reaches the workpiece surface. A variation is presented in Tzanavaras et al, U.S. Pat. No. 5,421, 987, wherein a collimating screen of substantially annular shape is employed to tailor the current distribution to alleviate edge and corner effects. Such field-shaping shields of this sort, however, either provide benefit only near the edges of the cathode, or they require a relatively large anode-to-cathode spacing to provide benefit across the whole workpiece cathode diameter, such that they are not readily adapted to shape the field continuously across the diameter of the workpiece cathode.

There are also other specific problems, moreover, that are particularly involved in the electroplating of silicon wafers and the like. One such is created by virtue of the fact that the conductive seed on a wafer may not be of equal thickness at all points on the wafer, for example, the seed may have a radial pattern that is related to the symmetry of the system in which the seed layer was deposited. Another factor resides in the fact that in wafers of relatively large diameter having thin seed layers, the ohmic resistance drop from wafer workpiece edge to center can cause non-uniform electric field distribution across the wafer. An economical means of counteracting this non-uniformity is therefore desirable. The present invention, as also later fully described, also addresses these problems by tailoring the current distribution continuously across the radial dimension of the wafer surface, and in a manner that is not necessarily monotonic along a radius of said surface, and further in a manner such that uniform plated film thickness across the cathode wafer workpiece surface may be achieved within a process chamber height that can be made relatively small, say, for example, about one sixth of the diameter of the workpiece cathode itself

OBJECTS OF THE INVENTION

It is thus a primary object of this invention to provide a new and improved generic method of and apparatus for controlling fluid flow in the wet processing of workpiece surfaces, and particularly, though not exclusively, in electroplating and similar processes also requiring electric field usage and control; and that shall not be subject to the above-described prior art disadvantages and limitations, but, to the contrary, shall enable particular adapting to the electroplating of semiconductor silicon and related thin wafers and the like and cluster tools for their fabrication.

A further object is to provide a new and improved wet process chamber suitable for high-volume manufacturing applications in semiconductor workpiece fabrication and in other similar precision fluid-based deposition or removal of films from substantially thin workpieces with substantially flat surfaces.

Another object is to provide a novel electroplating chamber that produces metal-deposited films of uniform thickness, high purity, and uniform electrical properties on flat continuous uniform surfaces, on flat continuous surfaces with micro-scale topography, and on flat surfaces with both topography and photo-resist patterning.

Still a further object of the invention is to provide a novel wet process chamber that is compact in size.

Another object is to provide an improved wet process chamber that is reliable and robust when operated continuously, as a result of minimization of the number of moving parts.

A further object is to provide an electroplating chamber that operates as an independent module and can be reliably integrated into a cluster tool automatically to distribute workpieces between and amongst a plurality of such modules, with the workpiece carriers used to move workpieces amongst tools in the manufacturing facility in which the cluster tool operates.

Still another object is to provide an improved wet processing chamber particularly adapted for electroplating, stripping, etching, and cleaning workpieces such as semiconductor wafers and the like.

A further object is to provide for the integration of such an improved wet processing chamber into a robotic cluster tool which moves workpieces between said chamber and workpiece carriers used to move workpieces about the fabrication area, Another object is to imbue such a wet processing chamber with robust and modular characteristics so that it may be efficiently removed from the cluster tool and repaired or replaced, when necessary.

It is still a further object of this invention to provide a novel wet processing chamber that requires only a minimal amount of equipment space per workpiece movement, per hour, enabling economy in a robotic cluster tool configuration.

Another object is to provide a wet processing chamber in which fluid mixing is controllable within the chamber ranging from laminar flow to turbulent flow.

It is a further object of this invention to provide an electro-deposition chamber that produces improved substantially uniform metal depositions of controllable thickness.

Still a further object of this invention is to provide a novel electro-deposition chamber for semiconductor wafers and the like adapted to compensate for the potential drop in very thin seed layers in the wafers, or radially non-uniform seed layers, and still produce substantially uniform metal deposited layers.

It is another object to provide a wet process chamber that produces improved complete fluid mixing throughout the chamber and especially near the workpiece surface.

An additional object is to provide such a novel electro-deposition chamber in which problems due to bubble entrapment at the depositing metal surface on the workpiece are eliminated.

Other and further objects will be explained hereinafter and are more fully delineated in the appended claims.

SUMMARY

In summary, from one of its important aspects, the invention embraces in an electroplating process for a cathodically connected thin workpiece between which and an anode an electric field is established within an electroplating fluid chamber, a method of improving the control of fluid flow and uniformity of the electroplating of the workpiece, that comprises, agitating the fluid by internally cyclically reciprocally rotating the fluid back and forth in the chamber between the cathodic workpiece and its anode and laterally over the workpiece cathode.

The invention thus embodies a novel chamber for the wet electroplating processing of preferably substantially thin and flat workpieces like semiconductor wafers and the like, and having several features that are also of particular value and usefulness in the other wet processing applications, such as the before-mentioned electro-less plating and photo-resist stripping and cleaning of workpieces. The chamber contains a fluid agitator and means for rotating said agitator in a reciprocating manner in order to avoid Coriolis motion and to cause fluid mixing, and, where appropriate, a plurality of radial electric field shields may be attached to the agitator of shield shape adjusted to optimize the application of electric fields at the workpiece surface, and more generally, in various types of wet processes, to optimize the fluid agitation at the workpiece surface.

Preferred and best mode designs are hereinafter set forth in detail and are there more fully explained.

BRIEF DESCRIPTION OF THE DRAWINGS

The invention will now be explained in connection with the accompanying drawings, wherein.

Figure 1:
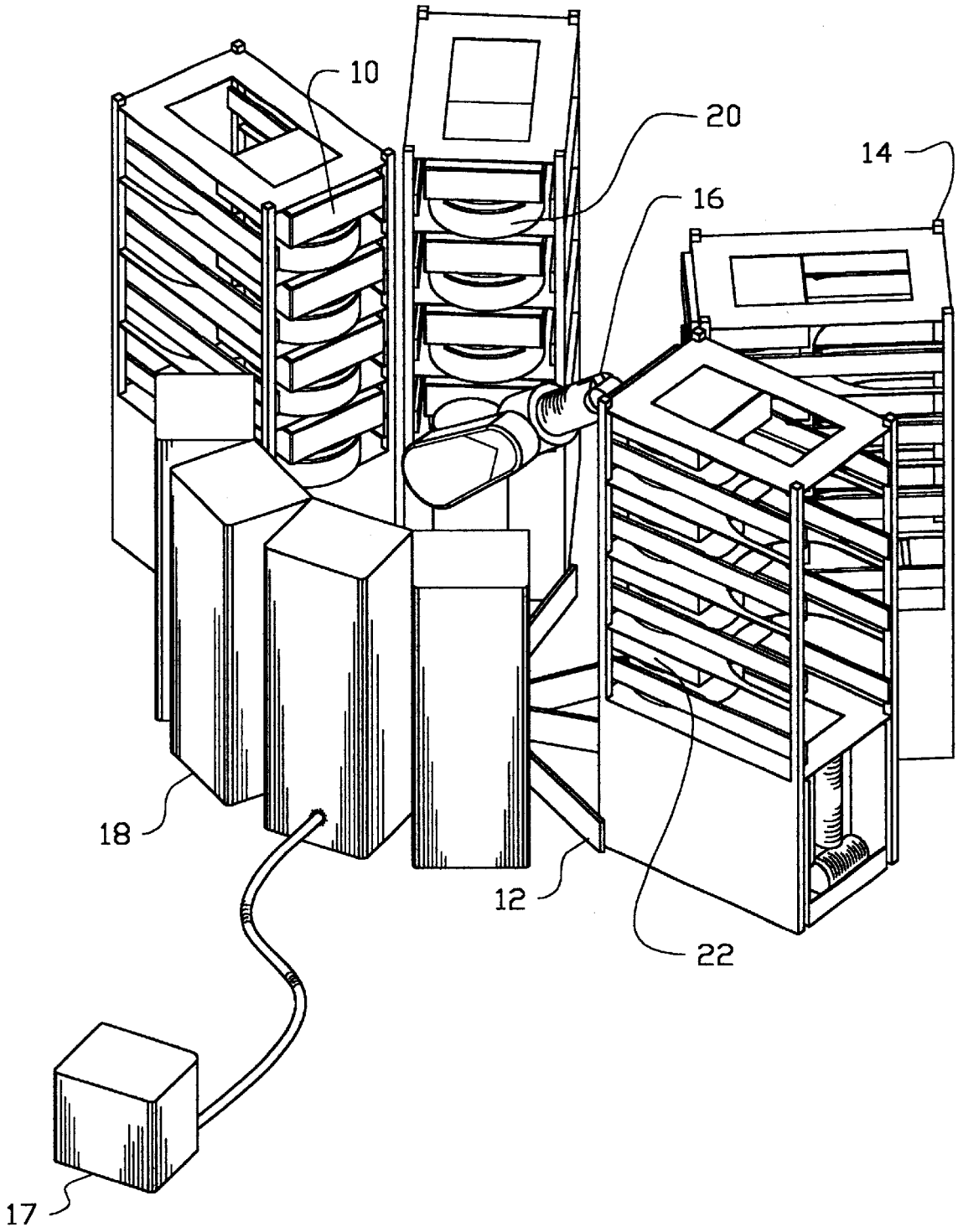
FIG. 1 is an isometric view of a preferred embodiment of the invention as applied to wafer processing, illustrating a plurality or stack of electroplating process chamber modules configured along with a wafer handling robot to comprise a novel wet process cluster tool.

General Aspects of Advantages of Cyclical Reciprocating Agitation

A rotational reciprocating agitator is disposed between each cathode workpiece and its anode within each cylindrical electroplating chamber of the stack, or may be located between the bottom and top planes of other wet processes such as etching or cleaning chambers. In the preferred electroplating application, however, the agitator is composed of a plurality of radially extending blades that are shaped and configured such that rotation of the agitator about a central chamber longitudinal axis perpendicular to the parallel cathode and anode planes and aligned with the center of the cathode, causes fluid within the chamber to be evenly and repeatedly mixed throughout the chamber, especially laterally at the workpiece cathode surface. In addition, the blades have a cross-sectional shape parallel to the plane of the cathode and anode that preferably is substantially a radial wedge or sector of constant angle. Consequently, the radial uniformity of the time-averaged electric field between the cathode and anode is not disrupted by the movement of the agitator itself as it reciprocatingly rotates around the longitudinal axis. The use of reciprocating rotational motion in the present invention to mix the plating solution in the chamber, as distinguished from continuous rotational fluid motion that, as earlier stated, causes fluid particles to travel in circles known as Coriolis motion, breaks up this pattern and causes thorough and uniform mixing throughout all parts of the chamber and along the workpiece surface. Experimentation shows that such fluid agitation is strong enough to break up entrapped gas bubbles and carry them out of the chamber along with the fluid overflow. Even with the worst-case condition created by injecting air into the chamber, the air is prohibited by the reciprocating agitator motion from attaching to the workpiece surface, avoiding deleterious non-uniform electroplating deposition on said surface.

The design of the chamber, furthermore, produces this thorough solution mixing at the workpiece surface with a very desirable short axial chamber length. This compact vertical size allows for the modular stacking of the chambers in the vertical direction within a cluster tool. The resulting tighter packing of process chambers in a cluster tool, in addition, significantly increases the workpiece throughput per cluster tool—an advantage both in utilization of floor space and in utilization of capital.

The invention thus provides for adequate fluid mixing in the chamber without the need for a large volume flow of fluid through the chamber, such that fluid transfer into and out of the chamber is determined only by the rate required to avoid depletion of reactants due to their consumption at the workpiece surface. For example, in electroplating, this is dependent on the rate at which metal ions are consumed at the cathode workpiece surface. The fluid volume flow required to avoid ion depletion is much lower than the fluid volume flow required in a typical prior-art fountain plater, before-discussed, or in a nozzle anode plating chamber, where fluid mixing uniformity at the workpiece surface is dependent upon fluid input flow rate. Because lower volumes of solution need to be pumped through the system of the invention, furthermore, smaller lines and quick- connect fittings can be used for both the pressurized input lines and the gravity return lines. System assembly and maintenance is therefore more economical, and a chamber can be quickly removed from the cluster tool and replaced into the cluster tool with minimal impact to overall system uptime.

The cathode and anode surfaces, in the design of the chambers of the present invention, moreover, extend completely to the dielectric wall of the chamber, providing very good field uniformity for maximum plated film macro-scale uniformity. Unlike typical prior fountain cell plating chamber designs, it is not necessary, in accordance with the invention, to pass fluid through the anode, and hence there is no direct coupling and competition between design of the anode geometry for field uniformity and design for fluid flow uniformity. The invention thus provides novel independent control of electric field uniformity and fluid agitation at the workpiece surface.

DETAILED DESCRIPTION OF A PREFERRED EMBODIMENT OF THE INVENTION

Referring to FIG. 1, the invention, as applied to the illustrative and important field of electroplating and the like, embodies a plurality of stacks of similar electroplating process chamber modules 10 that can be readily configured into an automated wafer processing cluster tool 12. In the embodiment shown, a plurality of vertically stacked process module frames 14 support the corresponding plurality of stacks of process modules 10. Externally visible are each of the process chamber bodies 20, more particularly shown on an enlarged scale in FIG. 2, and the process module cover 22. The process module frames 14 circumferentially surround the wafer handling robot 16 of well-known type such that the robot is able to insert wafers horizontally into and retrieve wafers horizontally from all process modules. A suitable wafer-handling robot for the purposes of this invention may, for example, be the Staubli Unimation RX-90 for this preferred embodiment of the invention. A conventional cluster tool controller 17 controls the motion of the robot 16 and coordinates wafer exchange between the robot 16 and the process modules 10. The robot moves the wafers from wafer cassette transfer stations 18 to horizontal positions in the wafer process modules 10 or between different process modules 10 in present-day well-known sequences; as, for example, in wafer cassette transfer stations of the type manufactured by Asyst Corporation or Dynamic Automated Systems Corporation. The cluster tool 12 may also contain other components, not shown since in order to avoid detracting from the essential features of the invention, such as, for example, walls and air filters. These are suitably positioned as is well known—the present invention pertaining to the novel design of the wet process module 10 suitable for the invention does not reside in the details of the other well-known auxiliary components that together comprise and are used in cluster tools 12.

Figure 2:
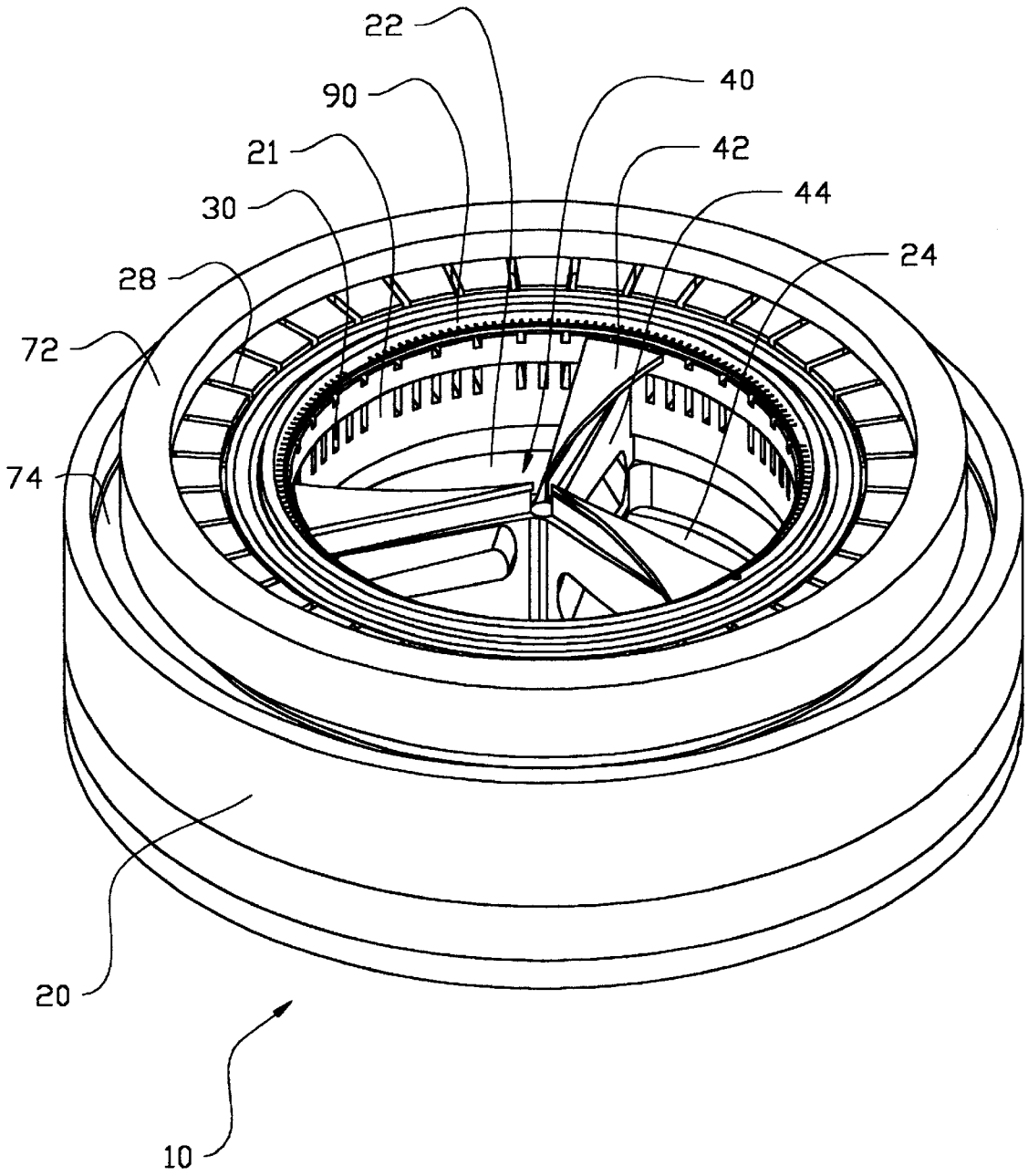
FIG. 2 is a similar view of one of the process chambers constructed in accordance with the invention and with the cover shown removed and without a workpiece in place, illustrating the details of the rotating shield and rotor components situated in the chamber.

In said FIG. 2, the main components of the process chamber body 20 are evident, comprising a chamber cavity 22 containing process fluid 24, a plating electrolyte bath, for example. The chamber inner body is fabricated from suitably acid-resistant material such as PTFE for acid-based processes like plating or etching, and from non-magnetic material like aluminum or type 316 stainless steel for organic based processes such as, for example, in the previously mentioned photo-resist stripping applications. A novel reciprocating rotational agitation rotor assembly 40 and novel electric field shields 42 are disposed in the center of the chamber cavity 22. These are important aspects of the invention and will now first be generally discussed and then will be discussed in detail with reference to subsequent figures. A workpiece holding structure 90 is disposed around the perimeter of the chamber cavity 22. This structure is suitably constructed in the case of electroplating process chambers 20 to provide electrical contact to a horizontally disposed planar workpiece cathode to-be-plated (not shown in FIG. 2 but illustrated as circular thin planar wafers 60 in FIGS. 4 and 5 ) by an electric field established between it and a parallel flat anode surface 82, FIGS. 4 and 5. Output flow slots 28 and bypass flow slots 30 are evident in the chamber body 20, and their use will be discussed with reference to subsequent figures.

Implementation of Rotational Agitation

Figure 3:
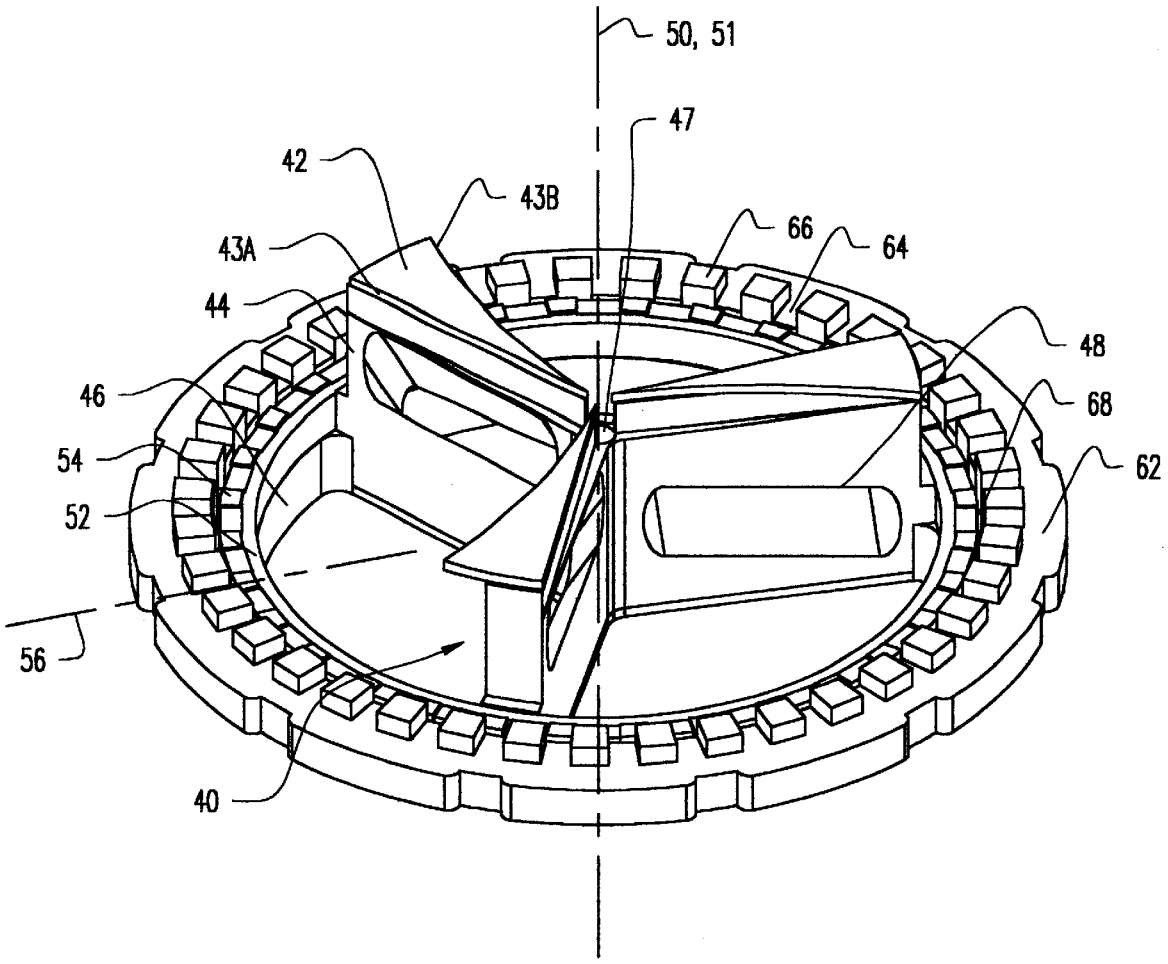
FIG. 3 is an isometric view of the agitation rotor components, without showing the accompanying chamber, showing in detail the construction of the magnetic rotor.
Figure 4:
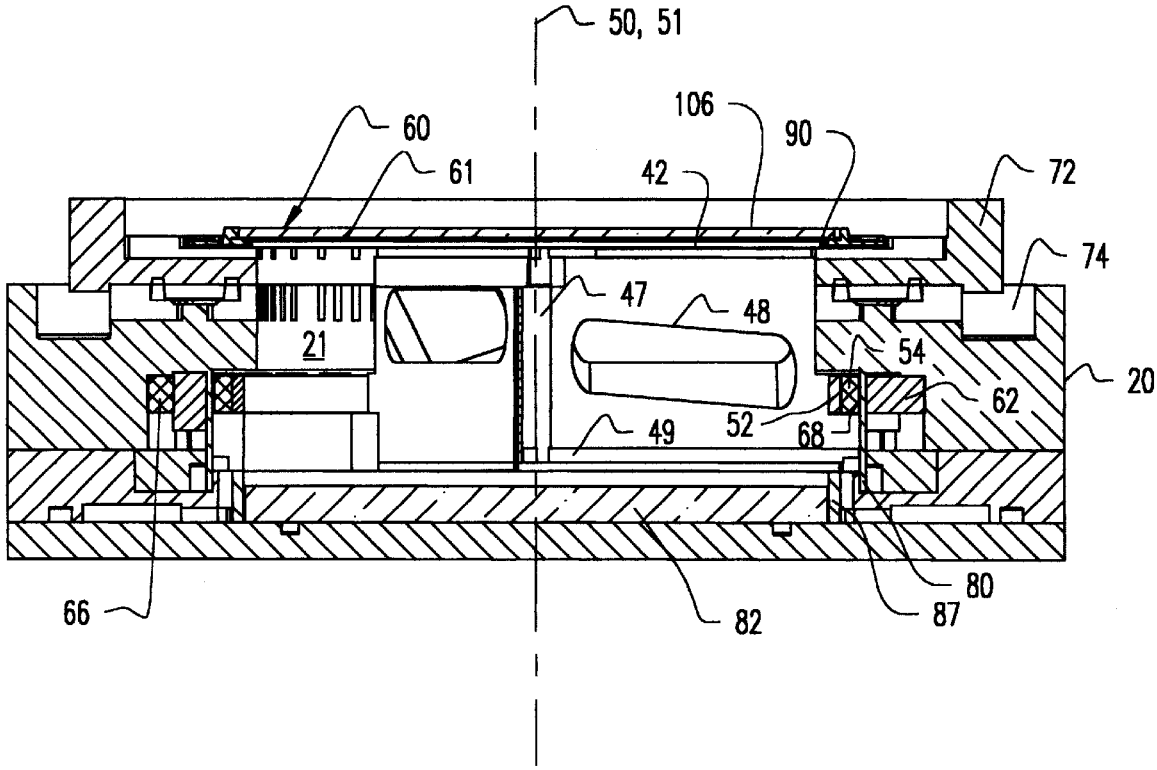
FIG. 4 is a cross-sectional view of the electroplating process assembly with a workpiece in-place.

Referring to FIGS. 3 and 4, the construction of the cyclically reciprocating agitation rotor assembly 40 of the invention can be more readily seen. A plurality of spaced radially extending agitation blades or vanes 44 are attached to a rotor perimeter ring 46, FIG. 3. Each blade has a fluid flow window 48 cut into it that directs fluid flow to and from the wafer working surface 60 as the agitation rotor assembly rotates about its longitudinal rotation axis 50. A center flow hole 47 directs flow toward the center 104 of the wafer 60. Input fluid flow is channeled in a rotor blade flow channel 49 that extends from the rotor perimeter across the bottom of each blade 44 to connect with the center flow hole 47. The rotation axis 50 is disposed substantially perpendicular to the wafer working surface 60 and is aligned with the center of the wafer. Attached upon the rotor perimeter ring 46 is a rotor back iron 52 to which a plurality of circumferentially spaced magnets 54 are attached. The magnets 54 are suitably disposed with each of their magnetic field axes 56 oriented transversally, substantially perpendicular to the longitudinal rotation axis 50, and with the magnetic field direction alternating in north and south directions between adjacent magnets. The circumferential rotor back iron 52 and magnets 54 are coated with a suitable protective coating 58 to prevent their being corroded by the acidic plating solution or bath (24 in FIG. 2). A rubber-like material such as ethylene propylene provides an appropriate protective coating 58. Disposed around the rotor assembly 40 is a concentric outer stator 62, FIG. 3, with a plurality of successive circumferential teeth 64 and coil windings 66, defining an annular space between the ring of rotor magnets and the coaxially surrounding stator teeth that may be referred to as a motor air gap 68. In combination, the rotor back iron 52, magnets 54, stator 62, windings 66 and motor air gap 68 form a permanent magnet DC motor.

Figure 5:
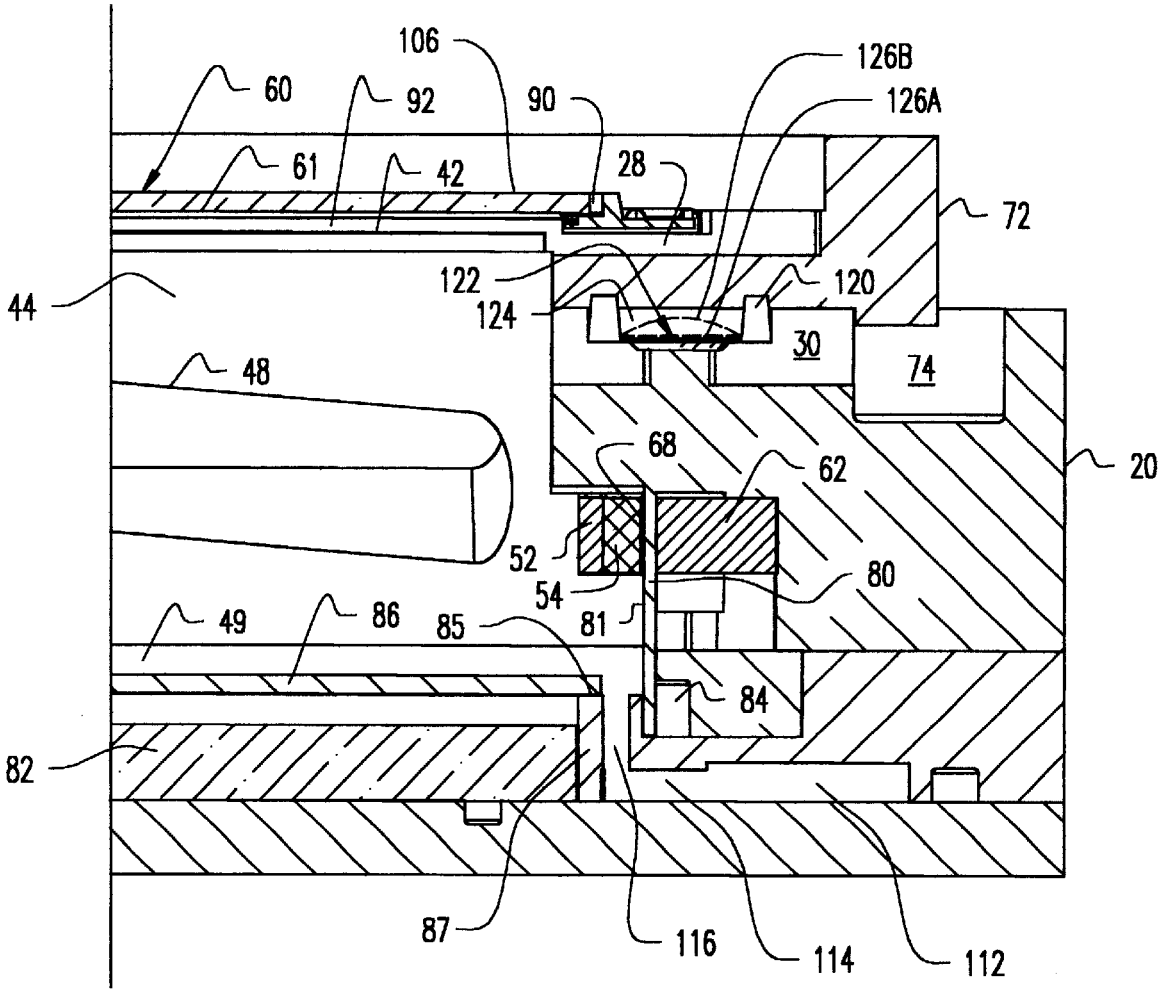
FIG. 5 is a cross-sectional view upon a larger scale of the rotor periphery, showing in detail how the rotor is supported as a shaft in a journal defined by the interior chamber wall, and how the fluid flows into the chamber.

The incorporation of such a permanent magnet DC motor within the process chamber 20 can be seen in more detail in FIGS. 4 and 5. A thin section of chamber wall 80 is disposed in the air gap 68 between the rotor 40 and the stator 62. A fixed o-ring seal 84, FIG. 5, seals against the chamber wall section 80 to prohibit process fluid 24 from leaking out of the chamber cavity 22. Using such an arrangement together with a suitable power supply and control system to drive electric currents in the stator windings 66, the agitation rotor assembly 40 can be rotated at any desired speeds and in reversible directions to stir the process fluid 24.

This novel arrangement of the fluid agitation apparatus solely within the process chamber is particularly advantageous for at least two reasons. First, process fluid 24 is prevented from leaking from the chamber cavity 22 because no rotating mechanical coupling must pass through the chamber wall 21, FIGS. 2 and 6. Second, a secondary drive mechanism, as is used, for example, in magnetically coupled pumps or stir bars, is not required since in this invention the motor is built into the agitator system itself, thereby providing a compact and robust system. Referring again to FIG. 5, it can be seen that the agitation rotor assembly 40 is positioned in the chamber cavity by direct contact along a substantially cylindrical interface 81. Such interface, along with the process fluid 24, serves as a journal bearing to provide a means of centering the agitation rotor assembly 40 in the chamber cavity in a plane substantially perpendicular to the rotation axis 50 (FIG. 4). A preferred embodiment uses low friction materials such as PTFE for both the rotor perimeter ring 42 and the chamber wall 80 to eliminate frictional wear at the interface 81. The agitation rotor assembly 40 is positioned in the axial direction by contact at a substantially circular planar interface 85 between the rotor bottom 86 and the chamber bottom wall 87. While there is some residual magnetic attraction force between the rotor assembly 40 and the stator 62, this force is aligned substantially perpendicularly to the axis of rotation 50 and is proportional in magnitude to the distance between the stator axis 51 and the rotation axis 50, the force being resisted by the aforementioned journal bearing surface 81. Tests have shown that using components fabricated with reasonable manufacturing tolerances, the axial alignment between said rotor axis 50 and stator axis 51 is such that the load applied to the journal bearing interface 81 does not cause frictional wear at said interface.

The novel design of the present invention thus uses magnetic field coupling to the agitator body 40 that is submersed in the fluid chamber, with the motor effectively integrated into the chamber wall. The magnetic rotor assembly 40, as before discussed, is suitably protected by a coating such as ethylene-propylene so that it will not be dissolved by acids in the plating solution 24. The rotor assembly is mated with the agitator body and fully contained within the chamber. The stator 62 may be fabricated using known motor fabrication methods from steel lamination, and the coil windings 66 are disposed concentric to said rotor. In the exemplary embodiment, as before explained, a section of the chamber wall 80 (FIGS. 4 and 5) is disposed between the stator 62 and the magnetic rotor 54, in the so-called air-gap 68 of the motor, to protect the stator from the acidic components of the plating solution.

The motion of the magnetic assembly and coupled agitator is controlled by supplying current pulses to the winding 66 of the stator. Known methods of servo motor control may be used to control the rotor motion. In an apparatus tested, a three-phase coil winding with 39 stator poles 66 and 33 rotor magnets 54 was used for a 9-inch diameter processing chamber 20. The motor was controlled using an Advanced Motion Control BE15AH brushless servo amplifier. This method of agitation used reciprocating circular motion of the agitator 40–44 within the process fluid 24, providing uniform mixing at the wafer working surface 60 and avoiding the fluid stratification that, as earlier discussed, occurs due to Coriolis motion resulting from prior art unidirectional rotation. Reciprocating agitator motion of approximately 110 degrees clockwise followed by slightly different 120 degrees counterclockwise at a speed of 5 to 10 RPM has been found to perform well in electroplating tests. The internal chamber direct drive permanent magnet motor described herein has been found to be highly reliable in delivering the required cyclically reciprocating or reversing motion.

General Considerations of Advantages of Averaged Uniformity Electric Fields Shields The invention, in its application to electroplating and other wet processes using electric fields, also includes the provision of insulating plates or shields 42 preferably attached to the top surfaces of the agitator blades 44. These insulating plates behave as electric field shields that block the direct passage of the electric fields between the anode and the cathode workpiece wafer in the vicinity of the shield. The shields can be configured such that, at the cathode workpiece surface, the time-averaged electric field due to movement of the combination of agitator and shields, is substantially uniform across the entire surface. In another exemplary embodiment, the shields may be configured so that at the cathode surface, the time-averaged electric field due to movement of the combination of agitator and shields may occur as a radial pattern that interacts with the radial voltage drop due to current flow through the metal seed layer of the wafer. The interaction is such that a substantially uniform thickness metal film deposits on the workpiece wafer. Experimentation has shown, as later discussed, that the deposited film thickness profile can be varied from convex (thick at the workpiece perimeter) to concave (thick at the workpiece center) by varying the shield profile from narrow to wide at the shield perimeter. A desirable substantially uniform thickness profile is obtained at an intermediate shield profile.

The shield shape, moreover, may also be controlled in the direction perpendicular the workpiece surface. The relative velocity between the shield and workpiece is proportional to the radial distance from the workpiece center. For some applications, in particular when a very high degree of mixing is required at the workpiece surface, it may be required to contour the shield thickness such that the separation between the shield surface and workpiece surface is greater at the workpiece perimeter than at the workpiece center. Such contouring provides a uniform fluid boundary layer thickness across the workpiece surface.

An offset maybe provided between the angle of forward and reverse rotations, for example, the before-mentioned 120 degrees of rotation clockwise followed by 110 degrees of rotation counterclockwise. This offset causes the reversal point to shift continuously around the workpiece during the whole wet process operation, avoiding any possible non-uniformity that could result from repeatedly stopping and reversing at an angular position.

Implementation of the Electric Field Shields

Referring to FIGS. 3, 4 and 7, the benefit of this invention for shaping the electric field at the workpiece wafer surface 60 may be observed. A near ideal electric field pattern within the chamber cavity 22 is provided because no rotation shaft must pass through the anode 82, and therefore the anode can be configured in the shape of a continuous flat circular planar surface parallel to the flat planar wafer cathode workpiece 60. Since the fluid flow in the chamber is determined by the rotating agitator 40, moreover, there is no requirement for the provision of flow holes in the anode 82 or a space between the anode 82 and the chamber anterior wall surface 21. The wafer working surface 60 and the anode 82 can thus be substantially flat circular parallel spaced surfaces and extend with their respective perimeters substantially at the dielectric cylinder walls 21 that define the electric field boundary of the chamber. In addition, the electric field at the wafer working surface 60, as just previously described, can be shaped by means of rotating radial wedge-shaped or sector shields 42, FIG. 3, fixed to and carried at the top of the radial wedged-shaped sector agitator blades 44 of the rotating assembly 40. One edge 43A of each wedge shield 42 extends along a radius extending from the rotation axis 50. The opposite edge 43B of the shield is preferably contoured as it radially extends so that, as the shield rotates about the rotation axis 50, the time-averaged electric field flux at a point on the working surface 60 is a function of the radial distance from the rotation axis 50.

Figure 7A:
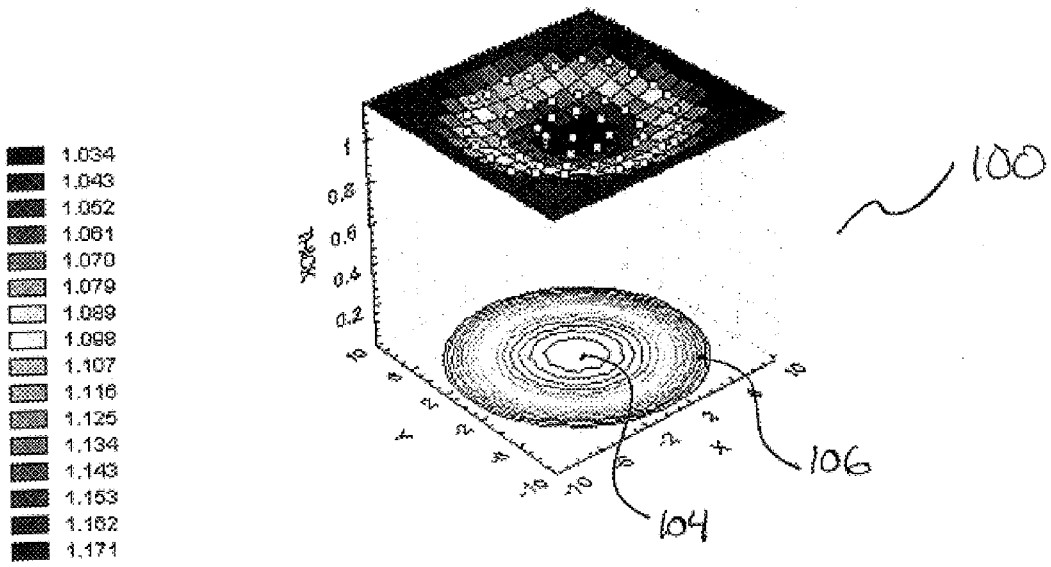
FIGS. 7A and 7B are plots of data showing the results of electric field contouring using the electric field shields of the invention for relatively small and larger shields, respectively.
Figure 7B:
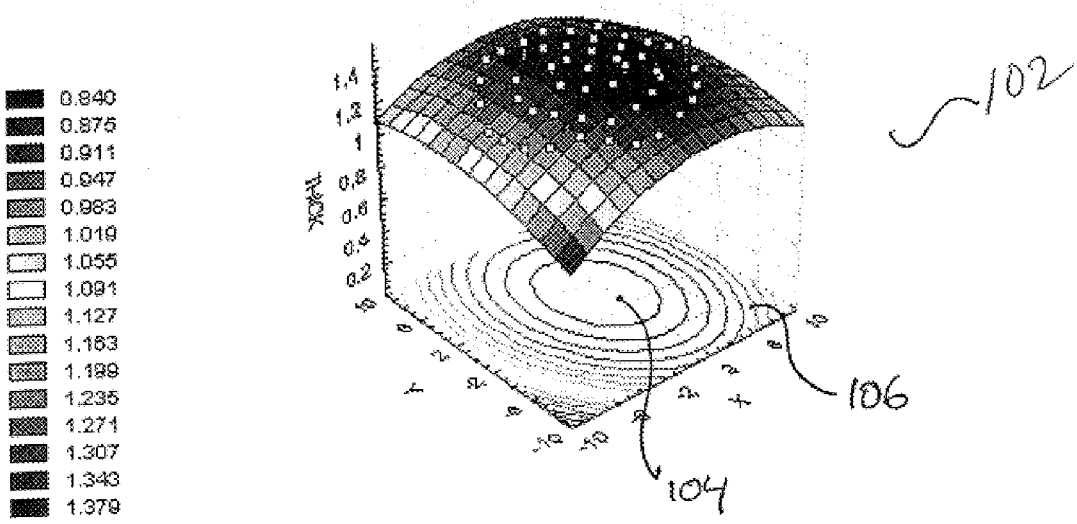

FIG. 7 shows the metal film thickness measurements obtainable for two different wafers processed with two different sets of such shields 42. The first graph 100, FIG. 7A, shows the thickness profile that resulted from using such wedge-shaped sector shields 42 wherein both edges 43A and 43B follow strictly diverging radial paths extended from the data rotation axis 50. Less metal is deposited in the center 104 of the wafer, (FIG. 4 and FIG. 7A) because of the ohmic resistance potential drop in the wafer seed layer 61 as deposition current flowed from the electrical contact 90 at the wafer perimeter into the center 104 of the wafer 60. The second graph 102 of FIG. 7B, shows the thickness profile that resulted from using shields 42 where the edge 43B follows a path which curves away from a strict radial line as it proceeds from the rotation axis 50 to the chamber wall 81. Less metal is deposited at the edge 106 of the wafer 60 because the shields 42 block electric flux from the anode horizontal surface 82 to the parallel horizontal wafer working surface 60 more at the wafer edge 106 than at the wafer center 104.

Electroplating Fluid Flow Considerations

Figure 6:
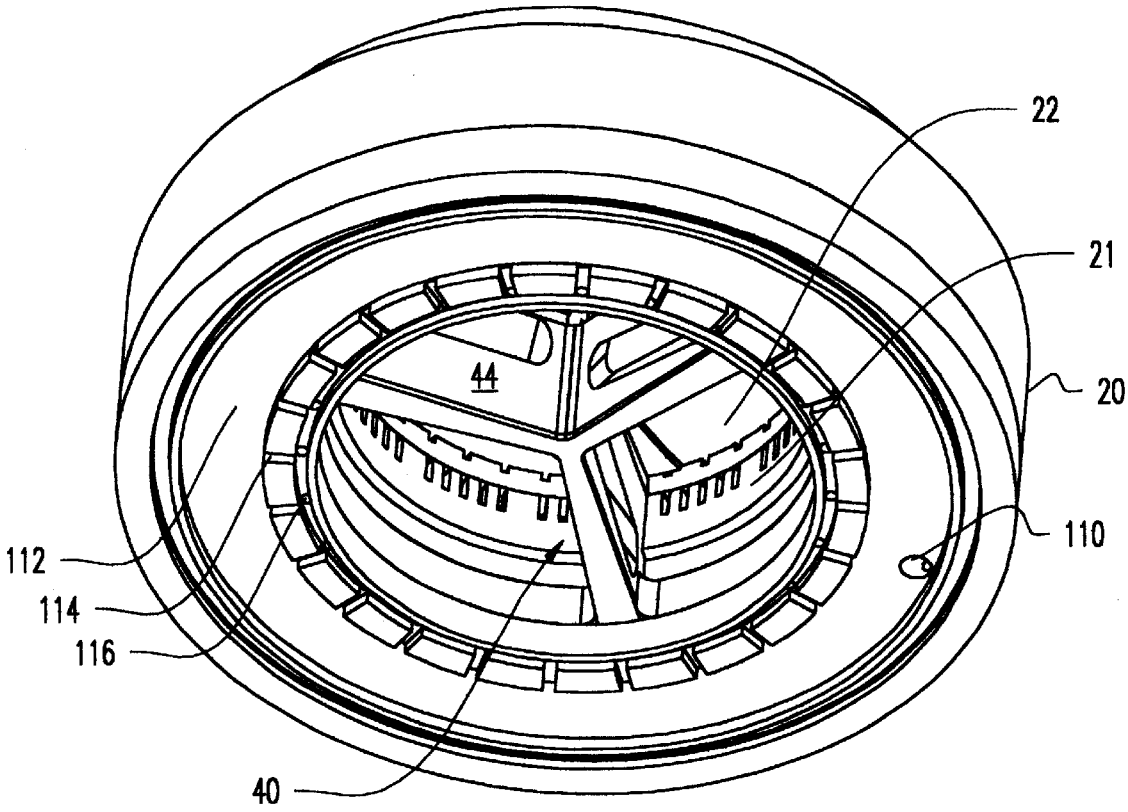
FIG. 6 is an isometric view of the process chamber with the bottom of said chamber removed to highlight the path through which fluid flows into the chamber.

The details of fluid flow through the chamber cavity 22 can be seen more clearly in FIGS. 5 and 6 An input hole 110, FIG. 6, is suitably attached to piping attached to the process fluid pump, filter, and reservoir of conventional type (not shown). Process fluid 24 flows into the input manifold 112, FIGS. 5 and 6, which is disposed substantially circularly around the chamber cavity 22, and then flows through radial slots 114 and up through vertical holes 116, FIG. 5 The fluid flow then splits into three paths: (1) through the rotor bottom fluid channel 49 and up through the central flow channel 47, FIG. 3, thereby dispensing substantially near the center of the wafer working surface 60 and laterally outward, (2) through the axial interface 85 and cylindrical interface 81, lubricating said interfaces, and (3), out of the chamber cavity passing through upper output slots 28, FIG. 5, and over the main weir 72 into the main drain 74 which is suitably connected to piping that returns fluid to the reservoir (not shown). A particular advantage of the invention is this distribution of fresh process fluid 24 directly to the center and laterally outward of the wafer working surface 60 while providing immediate mixing of all fluid that enters the process chamber 22.

Alternatively, preferably during periods during which a workpiece 60 is being loaded into or out of the holding structure 90, the fluid may pass out of the chamber without touching the wafer working surface 60. Fluid control diaphragm 120 is pulled away from the valve surface 122 by applying vacuum to chamber 124 through suitable piping (not shown). The control diaphragm then moves from position 126A to position 126B and fluid flows through output control slot 30 into the main drain 74 and exits the chamber.

There remains to describe the means for precisely controlling the degree of fluid mixing at the wafer working surface 60. A gap 92, FIG. 5, exists between the upper surfaces of the shields 42 and the under surface of the workpiece wafer 60. By suitable contouring of the thickness of the shields 42, this gap 92 can be varied along the radius extending outwardly from the rotational axis 50. A wider gap 92 in the region of the wafer perimeter 106, FIGS. 4 and 5, may be used to counteract the enhanced mixing due to the higher relative velocity between the shield surfaces 42 and the workpiece surface 60 proportional to the radial distance from the rotation axis 50.

As before explained, in electroplating processes for wafer workpieces and the like, all of the following novel features of the invention synergistically and cooperatively combine to produce the improved results of the invention: reciprocating agitator rotation with (radial) electric field shields attached to the agitator and of shield shape adjusted to optimize the electric field at the workpiece surface and simultaneously to optimize the fluid agitation at such surface. Certain of the individual features, moreover, may also independently be used in other types of wet processing processes as where, for example, no electric fields or shields are required, or where the novel motor integration into the processing chamber wall is particularly useful, and further modifications will also occur to those skilled in this art and are considered to fall within the spirit and scope of the invention as defined in the appended claims.

What is claimed is:

1. In an electroplating process for a cathodically connected fixed thin workpiece between which and a fixed parallel anode an electric field is established within an electroplating fluid chamber, a method of improving the control of fluid flow and uniformity of electroplating of the workpiece, that comprises radially agitating the fluid by internally cyclically reciprocally rotating the fluid back and forth throughout the chamber between the cathodic workpiece and the anode and flowing the fluid laterally over the workpiece cathode.

2. The method of claim 1 wherein processing fluid flows into and out of the chamber, with fresh processing fluid distributed to the center of and laterally outward of the workpiece while effecting immediate agitation mixing of fluid entering the processing chamber.

3. The method of claim 1 wherein the chamber is vertically stacked in one or more stacks of a plurality of similar other chambers each containing a similar workpiece for electroplating and each with separate internal agitating in each chamber.

4. The method of claim 3 wherein the workpieces are robotically horizontally inserted into the chambers of the stack for electroplating and then horizontally retrieved therefrom.

5. The method of claim 4 wherein the stacks circumferentially surround the robotic insertion and withdrawal of the workpieces from a robotic cluster tool.

6. The method of claim 5 wherein the workpieces in the stacks of chambers are thin circular planar semiconductor wafers.

7. The method of claim 1 wherein electric- field shielding is simultaneously reciprocally effected between the workpiece and the anode during the agitating.

8. The method of claim 7 wherein said shielding is configured to cause the time-averaged electric field application between the workpiece and the anode due to the reciprocal agitating and shielding to be substantially uniform across the workpiece cathode to achieve a substantially uniform thickness of electroplate.

9. The method of claim 8 wherein the shielding is contoured to provide the desired electroplating thickness over the workpiece.

10. The method of claim 1 wherein the chamber is cylindrical and the agitating in the chamber is effected by cyclically reciprocally rotating circumferentially spaced radial blades within the fluid in the chamber.

11. The method of claim 10 wherein each of the blades, the cathodic workpiece and the anode are extended to the inner walls of the chamber.

12. The method of claim 11 wherein the rotation of the blades is effected by DC motor control integrated into said inner walls of the chamber.

13. The method of claim 12 wherein the DC motor control is effected by circumferentially mounting a ring of magnets carried as a rotor by the peripheral edges of the blades within a coaxially surrounding stator integrated in the said inner walls of the chamber.

14. The method of claim 10 wherein electric- field shielding is carried by the blades during their rotation in the fluid between the workpiece and the anode.

15. The method of claim 14 wherein the shielding is effected by wedged-shaped radially extending sectors attached to the top edges of the blades.

16. The method of claim 15 wherein the sectors are configured to cause the time-averaged electric field application between the workpiece and the anode due to the reciprocal agitating and shielding to be substantially uniform across the workpiece cathode to achieve a substantially uniform thickness of electroplate.

17. The method of claim 1 wherein the workpiece is a thin circular planar semiconductor wafer.

18. The method of claim 1 wherein the workpiece and anode have co-extensive planar parallel surfaces that are positioned to oppose one another through the fluid of the chamber, with the workpiece surface at the top and the anode surface at the bottom of the chamber, both extending to the inner walls of the chamber.

19. In an electroplating system for electroplating a fixed cathodically thin workpiece between which and a fixed parallel anode a electric field is established within an electroplating fluid chamber, apparatus for improving the control of fluid flow and uniformity of electroplating of the workpiece, having, in combination, fluid mixing means disposed within the chamber, and means for operating the mixing means to agitate radially the fluid by internally cyclically reciprocally rotating the fluid back and forth and throughout the chamber between the cathodic workpiece and the anode and flowing the fluid laterally over the workpiece cathode.

20. The apparatus of claim 19 wherein means is provided for processing-fluid flow into and out of the chamber, with fresh processing fluid distributed to the center of and laterally outward of the workpiece while effecting immediate agitation mixing of all fluid entering the processing chamber.

21. The apparatus of claim 19 wherein the chamber is vertically stacked in one or more stacks of a plurality of similar other chambers each containing a similar workpiece for electroplating and each with separate internal agitating mixing means in each chamber.

22. The apparatus of claim 21 wherein a robotic control is provided for robotically inserting the workpieces horizontally into the chamber of the stack for electroplating and then horizontally retrieving them therefrom.

23. The apparatus of claim 22 wherein the stacks of chambers circumferentially surround the robotic control for insertion and withdrawal of the workpieces as a robotic cluster tool.

24. The apparatus of claim 23 where the workpieces in the stacks of chambers are thin circular planar semiconductor wafers.

25. The apparatus of claim 19 wherein electric-field shielding is simultaneously reciprocally rotated in the fluid between the workpiece and the anode during the agitating.

26. The apparatus of claim 25 wherein the shielding means is configured to cause the time-averaged electric field application between the workpiece and the anode due to the reciprocal agitating and shielding to be substantially uniform across the workpiece cathode to achieve a substantially uniform thickness of electroplate.

27. The apparatus of claim 26 wherein the shielding means is contoured to provide the desired electroplate thickness distribution over the workpiece.

28. The apparatus of claim 19 wherein the chamber is cylindrical and the reciprocally agitating mixing means in the chamber comprises cyclically reciprocally rotating circumferentially spaced radial rotor blades.

29. The apparatus of claim 28 wherein the blades are operated to cause the time-averaged electric field application between the workpiece and the anode to be substantially uniform.

30. The apparatus of claim 28 wherein each of the blades, the cathodic workpiece and the anode are extended to the inner walls of the chamber.

31. The apparatus of claim 30 wherein the rotation of the rotor blades is effected by a DC motor system integrated into said inner walls of the chamber.

32. The apparatus of claim 31 wherein the DC motor rotor comprises a circumferential mounting ring of magnets carried by the peripheral edges of the blades within a coaxially surrounding stator integrated in said inner walls of the chamber.

33. The apparatus of claim 28 wherein electric-field shielding is carried by the blades during rotation in the fluid between the workpiece and the anode.

34. The apparatus of claim 33 wherein the shielding comprises wedged-shaped radially extending sectors attached to the top edges of the blades.

35. The apparatus of claim 34 wherein the sectors are configured to cause the time-averaged electric field application between the workpiece and the anode due to the reciprocal agitating and shielding to be substantially uniform across the workpiece cathode to achieve a substantially uniform thickness of electroplate.

36. The apparatus of claim 28 wherein the rotor blades are provided with fluid flow windows to direct fluid flow to and from the workpiece as the blades rotate about a central longitudinal axis.

37. The apparatus of claim 36 wherein a central fluid flow channel is provided to direct fluid flow upward toward the center of the workpiece.

38. The apparatus of claim 37 wherein the fluid flow is split into three paths; (1) through a channel along the bottom edges of the blades and up the central flow channel; (2) through the axial interface at the inner cylindrical wall of the chamber; and (3) out of the chamber cavity passing through upper slots.

39. The apparatus of claim 28 wherein the rotor blades are positioned in the fluid flow chamber by direct contact along the substantially cylindrical inner chamber wall interface, serving with the fluid as a journal bearing to enable centering of the rotor blades in the chamber, and in a plane substantially perpendicular to the rotation axis of the rotor blades.

40. The apparatus of claim 19 wherein the workpiece is a thin circular planar semiconductor wafer.

41. The apparatus of claim 19 wherein the workpiece and anode have co-extensive planar parallel surfaces that are positioned to oppose one another through the fluid of the chamber, with the workpiece surface at the top and the anode surface at the bottom of the chamber, both extending to the inner walls of the chamber.

42. In a wet processing system in which processing fluid flows against a fixed workpiece surface contained within a cylindrical fluid processing chamber, a method of improving the control of fluid flow and the uniformity of the processing of the workpiece, that comprises, agitating the fluid by internally cyclically reciprocally rotating spaced radial vanes disposed within the fluid and extending from the center of the chamber to the inner walls thereof.

43. The method of claim 42 wherein the rotation of the vanes is effected by DC motor control integrated into said inner walls of the chamber.

44. The method of claim 43 wherein the DC motor control is effected by circumferentially mounting a ring of magnets carried as a rotor by the peripheral edges of the vanes within a coaxially surrounding stator integrated in said inner walls of the chamber.

45. The method of claim 42 wherein the angles of the reciprocating agitation by the vanes in the opposite directions of rotation are adjusted to different values.

46. In a wet processing system in which processing fluid flows against a fixed workpiece surface contained within a cylindrical fluid processing chamber, apparatus for improving the control of fluid flow and the uniformity of the processing of the workpiece having, in combination, fluid mixing means comprising a rotor of spaced radial vanes disposed in the fluid of the chamber, and means for agitating the fluid by internally cyclically reciprocally rotating the spaced radial vanes of the rotor, the vanes extending from the center of the chamber to the inner walls thereof.

47. The apparatus of claim 46 wherein the rotation of the blades is effected by DC motor control integrated into said inner walls of the chamber.

48. The apparatus of claim 47 wherein the DC motor comprises a circumferential mounting ring of magnets carried as the motor rotor by the peripheral edges of the vanes within a coaxially surrounding stator integrated in said inner walls of the chamber.

49. The apparatus of claim 46 wherein the angles of the reciprocating agitation by the vanes in the opposite directions of rotation are adjusted to different values.

50. In a wet processing system in which processing fluid is contained in a cylindrical processing chamber, an apparatus comprising a rotor of spaced radial vanes disposed in the fluid with the vanes extending from the center of the chamber to its inner walls, and means for agitating the fluid by cyclically reciprocally rotating the vanes.

51. The apparatus of claim 50 wherein the rotor is provided with a ring of magnets carried by the peripheral edges of the vanes within a coaxially surrounding stator integrated in said inner walls of the chamber.

* * * * *